United States Patent [19]

Blough et al.

[11] 4,379,576

[45] Apr. 12, 1983

[54] SLIDING CLOSURE SECURITY SYSTEM

[76] Inventors: LeVone A. Blough, 4437 Mumford Dr., Hoffmann Estates, Ill. 60195; David L. Gregory, 10207 Union Park Dr., Orlando, Fla. 32817

[21] Appl. No.: 195,617

[22] Filed: Oct. 9, 1980

[51] Int. Cl.[3] ..... E05C 3/04

[52] U.S. Cl. ..... 292/205; 292/300; 292/DIG. 46

[58] Field of Search ..... 292/300, 205, 304, 207, 292/DIG. 46, DIG. 47, 104; 312/330, 348

[56] References Cited

U.S. PATENT DOCUMENTS

| | | | |
|---|---|---|---|
| 1,248,078 | 11/1917 | Chubbic | 292/104 |
| 1,361,594 | 12/1920 | Lawson | 292/205 |
| 2,584,575 | 2/1952 | Goldwasser | 292/205 X |
| 3,779,588 | 12/1973 | Raymon | 292/DIG. 46 X |
| 4,002,385 | 1/1977 | Hone | 312/348 X |
| 4,054,308 | 10/1977 | Prohaska | 292/DIG. 46 X |
| 4,062,576 | 12/1973 | Jennings et al. | 292/DIG. 46 X |
| 4,068,875 | 1/1978 | Miller | 292/DIG. 46 X |

*Primary Examiner*—Richard E. Moore

*Attorney, Agent, or Firm*—Kenneth E. Darnell

[57] ABSTRACT

Apparatus for securing sliding closures such as patio doors, the invention includes two cooperating structural elements carried one each by the respective sliding closures and which either allow or prevent relative movement between the closures. A first structural element carried by one of the closures is substantially disposed within the usual recess defined by the mating of a glass member with framing structure. A second structural element is pivotally mounted on an edge surface of framing structure of the other of the closures oppositely to and in alignment with the first structural element, the second structural element being pivoted into cooperating position relative to the first structural element to block relative sliding movement of the closures. The invention further includes block members fixed to upper edges of the closures between the closures and upper tracks within which the closures move, the block members preventing the lifting of the closures out of the track and thereby cooperating with the aforesaid element to secure the sliding closures.

15 Claims, 4 Drawing Figures

SLIDING CLOSURE SECURITY SYSTEM

BACKGROUND OF THE INVENTION

1. Field of the Invention

The invention relates to locking structure capable of preventing the opening of relatively slidable doors such as glass patio doors and the like. The invention further includes structure capable of preventing the lifting out of such doors from associated tracks within which the doors move.

2. Description of the Prior Art

Building practices over the last thirty or more years have often included sliding glass doors and large area sliding glass windows as a means for allowing visual and actual communications between the interior of a home and the out of doors. Such closures typically constitute two glass doors, one of which is stationary or fixed, and the other of which is slidable in a horizontal sense upon a track which is typically formed of metal. Both doors or closures typically fit within this track. In some situations, both of the doors are movable within the track. Latching or locking mechanisms usually supplied with such closures have unfortunately been subject to easy defeat by persons attempting to gain unauthorized entry into the home. Accordingly, forced entry through such closures is commonplace and constitutes the most usual mode of unauthorized entry into those housing structures fitted with such closures. Various supplementary locking and latching structures have been provided in the art for improving the security of such sliding closures, U.S. Pat. No. 926,460 to Benedict describes one such example of a locking structure for sliding doors, the structure including two relatively hinged members, one of which is attached to either a door or stationary framing structure while the other member pivots into a recess formed in a sliding door to prevent movement of the door. Voigt, in U.S. Pat. No. 1,112,738 provides a locking device for sliding doors in which a locking element disposed on the vertical edge surface of one of the doors extends into a recess formed in the other door to secure the doors. Hughes, in U.S. Pat. No. 2,759,748, discloses a sash fastener for windows wherein one element pivotally mounted on one of the windows is movable into an interengaging relationship with a stationary locking element mounted on a second window or on stationary window framing structure. In U.S. Pat. No. 2,818,919, Sylvan discloses a window locking structure having locking elements which can be moved into a cooperating relationship which prevents movement of the window frames. Grossman, in U.S. Pat. No. 2,941,832, provides a sliding door lock wherein a pivotable element mounted on one of the doors can be rotated into a recess formed in the adjacent sliding door or stationary framing structure. More recently, Silk, in U.S. Pat. No. 3,378,293, describes blocking elements for sliding closures wherein a hinged member mounted to the floor along track elements has a portion which pivots into blocking relation with a door movable within the track element. These and other prior art structures have met with varying degrees of success. Disadvantages of certain of the locking systems include the necessity for forming special recesses and similar receptive structure in at least one of the doors or in framing structure. Certain other locking systems have been as easily defeatible as the usual locking mechanisms which are formed integrally with such sliding closures. Further, the prior art has not included within a simple, inexpensive, and relatively easily installable locking system a structural feature which would prevent the lifting of the doors from the associated tracks. In spite of the numerous prior devices intended to accomplish at least a portion of the objects accomplished according to the present invention, there remains a need in the art for a simple locking system which can be readily installed without the use of special tools and without the necessity for modifying the sliding closures.

SUMMARY OF THE INVENTION

The invention provides a sliding closure security system capable in operation of preventing relative movement between either a pair of sliding closures or a sliding closure and stationary framing structure. Further, the present locking system prevents lifting of one or more of the sliding closures from associated tracks within which the closures move. A first structural element according to the invention is secured to one of the sliding closures, this first structural element being substantially U-shaped in cross section with one leg having a bend formed thereon which extends outwardly thereof to form a mounting flange. The mounting flange has at least one longitudinally extending slot formed therein to facilitate mounting of the first structural element to the closure, the element being adjustable by means of the slot. In operation, the U-shaped portion of the first structural element is substantially received near the corner of a closure formed typically of a planar glass member framed by an aluminum or similar frame and wherein an overall body recess is formed in the closure as defined by a planar surface of the glass member and peripheral edge surfaces of the frame. The closure is thus capable of passing relative to a second closure or framing structure since the first structural element does not extend outwardly a sufficient distance to prevent clearance between such closures. The first structural element is intended to be mounted at a slight spacing from juxtaposed vertical edge surfaces of the closure frame, this spacing allowing a portion of a second structural element to be received therein to bias against said first structural element and prevent relative movement between the closures. In practice, the second structural element is pivotally mounted to a typically vertical peripheral edge surface of a second closure or a stationary structure such as a frame to which the first closure is relatively movable. The second structural element can be pivoted into a contiguous relationship with the first structural element, thereby to block the closures against relative movement therebetween. The first and second structural elements can further be provided with apertures which mate on movement of said elements into a contiguous relationship, these apertures being utilized to fit a lock therethrough.

The locking system further comprises a block element which is preferably disposed on both closures along upper horizontal perimetric surfaces of the frames of said closures, the lock elements preventing lifting of the closures from associated tracks within which the closures move. Use of the present security system substantially increases the difficulty, of unauthorized entry through sliding closures such as patio doors.

Accordingly, it is an object of the present invention to provide a sliding closure security system which will securely lock sliding closures when in a closed position and which may be operated only from within the building secured thereby.

It is another object of the present invention to provide a sliding closure security system which includes locking elements disposed on respective ends of the closures and which may be urged into abutting relationship in order to prevent relative movement between the closures.

It is a further object of the present invention to provide a sliding closure security system including block members disposable along upper portions of sliding closures for preventing the lifting out of such closures from associated tracks within which the closures move.

Further objects and advantages of the invention will become more readily apparent in light of the following detailed description of the preferred embodiments of the invention.

DESCRIPTION OF THE PREFERRED EMBODIMENTS

Figure 1:
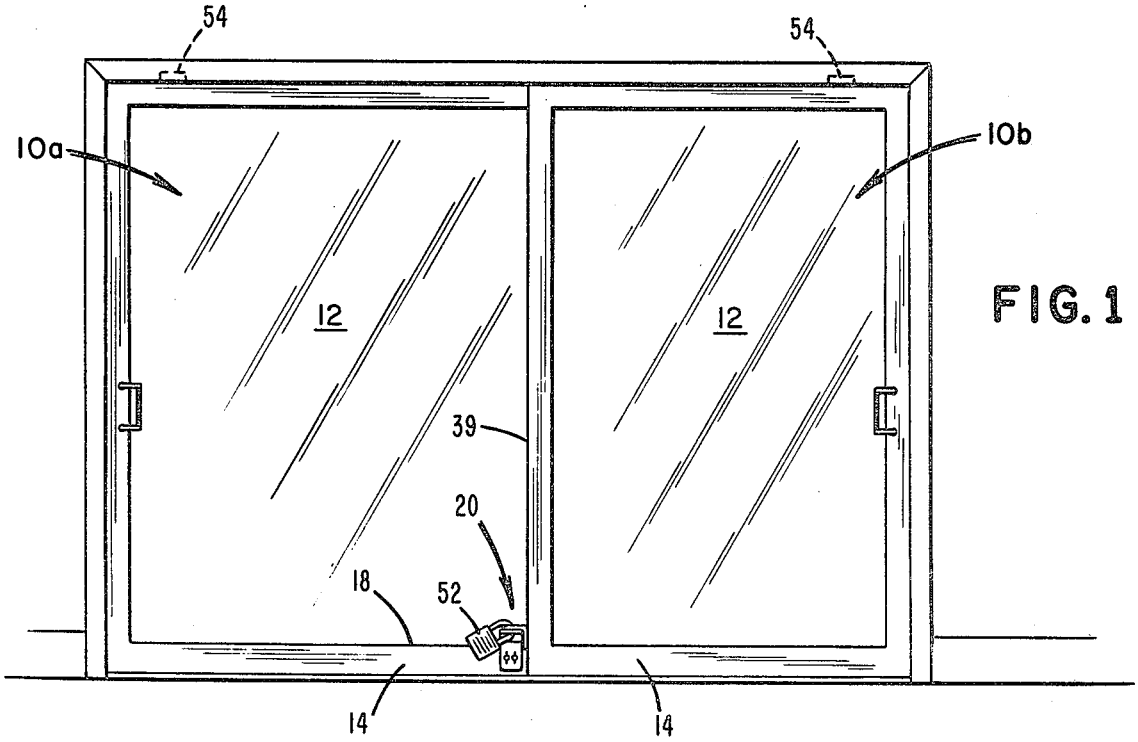
FIG. 1 is a front elevational view of the present locking system installed on relatively slidable patio doors.

Referring now to the drawings and particularly to FIG. 1, sliding closures represented by sliding patio doors 10A and 10B are illustrated as being essentially formed of glass panes 12 mounted within respective frames 14 as is conventional in the art. As illustrated, the sliding patio doors 10A and 10B are both movable relative to each other and to supporting building structure. However, the present invention is applicable to situations where only one of the closures is actually slidable. Further, the present invention is also useful where only one sliding closure is provided and such closure moves relative to stationary structure or moves into a channel formed in a wall of a building structure.

A first sub-system of the present locking system is preferably mounted to one of the sliding patio doors 10A or 10B on the inner side of the doors, that is, in the inside of the building in which the doors are installed. This first subsystem comprises a lock mechanism shown generally at 20, the lock mechanism being preferably installed at the lower corner of one of the frames 14 and on an opposing vertical edge surface of the other frame 14. As will also be noted in FIGS. 2 and 3, the glass pane 12 of patio door 10A is inset within the frame 14 to form a recess 16 bounded at the lower "center" (relative to the overall door structure) by horizontal peripheral edge surface 18 and vertical peripheral edge surface 19 of the frame 14. The lock mechanism 20 comprises a stationary lock element 21 and a pivotable stop element 38. The stationary lock element 21 can be formed of a single rectangular planar piece of material having a thickness of approximately ⅛ inch. This rectangular planar piece of material, which is preferably formed of metal, is bent into a U-shaped portion 22 at one end thereof to effectively form the stationary lock element 21. When the stationary lock element 21 is oriented in the position assumed when mounted to the door 10A, free leg 24 is seen to extend horizontally and flange 32 is seen to extend vertically from leg 30. Bight portion 28 of the U-shaped portion 22 is seen to be received within the recess 16 and to abut against the glass pane 12. The height of the legs 24 and 30 are such that the outer edges of the legs do not extend from the recess 16. The legs can extend minimally beyond the recess 16 in practice but not a sufficient distance to prevent relative movement between the doors 10A and 10B. The flange 32 acts to mount and support the stationary lock element 21, slots 34 being provided in the flange 32 to adjustably receive mounting screws 36 which fit through the slots into holes (not shown) drilled into the frame 14. Since the thickness of the flange 32 is approximately ⅛ inch or less, sufficient clearance exists between the sliding patio doors 10A and 10B to allow relative movement between the doors without contact between the flange 32 and the door 10B. Completing the description of the stationary lock element 21, an aperture 26 is seen to be formed in that end of the horizontal leg 24 farthest from the vertical peripheral edge surface 19 of the frame 14. The function of this aperture will be referred to hereinafter.

Installation of the stationary lock element 21 requires that a spacing 37 of approximately ⅛ inch be provided between the lock element 21 and the vertical peripheral edge surface 19 of the frame 14. This spacing 37 is necessary to allow cooperating structure of the stop element 38 to fit therewithin and thus produce the locking function intended according to the invention. This cooperation will be described in more detail hereinafter.

Figure 2:
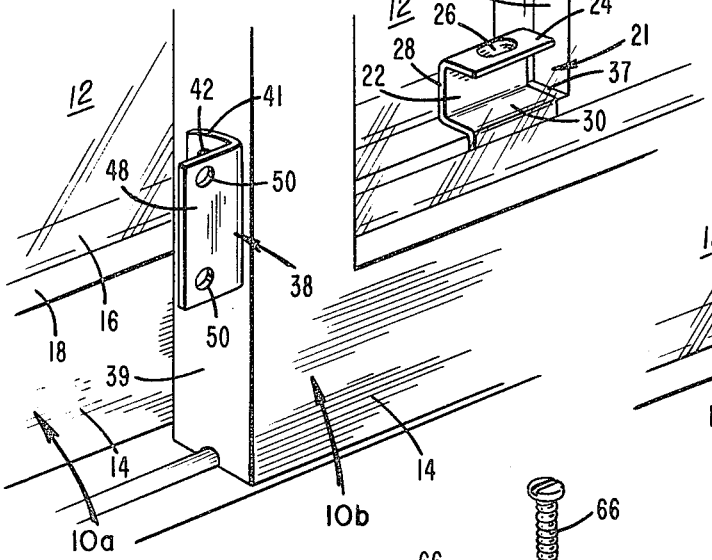
FIG. 2 is a detailed perspective view of a door lock comprising a portion of the present locking system, the lock being shown in an unlocked condition so as to allow relative movement between the doors.

As is seen in FIG. 2, the stationary lock element 21 is mounted on the sliding door 10A in a manner which allows said lock element 21 to pass relative to the sliding door 10B when the doors are moved relative to each other. As aforesaid, the U-shaped portion 22 of the lock element 21 is essentially received within the recess 16 with outer planar surfaces of the bight portion 28 preferably being contiguous to the planar surface of the glass pane 12 while outer surfaces of the leg 30 bear against the horizontal peripheral edge surface 18 of the frame 14. As aforesaid, lower planar surfaces of the flange 32 are contiguous to opposed surfaces of the frame 14 into which the screws 36 are received. Accordingly, the stationary lock element 21 is firmly mounted to the sliding door 10A in a manner which does not impair the usual functioning of the doors 10A and 10B.

Figure 3:
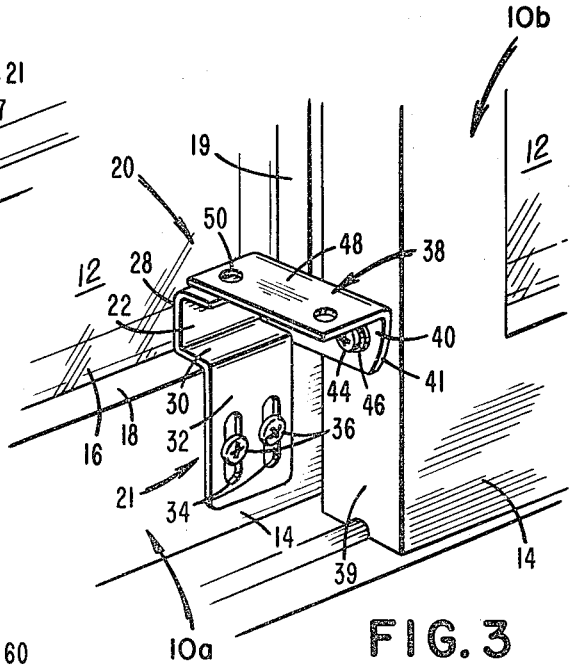
FIG. 3 is a detailed perspective view of the present locking system with the door lock shown in a locked configuration.

The stop element 38 of the lock mechanism 20 is seen particularly in FIGS. 2 and 3 to be mounted to vertical facing surface 39 of the frame 14 of sliding door 10B. The stop element 13 is mounted in a position on the sliding door 10B to be directly adjacent to the stationary lock element 21 when the doors are in the position shown in FIG. 3. The stop element 38 can also be formed of a single planar piece of material which is bent substantially medially of its length to form a base portion 40 and a flange 48. When in the locked position as shown in FIG. 3, the flange 48 is seen to be substantially horizontal while the base portion 40 is substantially vertical in orientation whether in the locked or unlocked configuration. The base portion 40 can be rounded at 41 to facilitate fitting of that portion of the stop element 38 into the spacing 37 for locking of the doors 10A and 10B. The base portion 40 is also provided with an aperture 42 through which a screw 44 extends to mount the stop element 38 to the frame 14. A nylon washer 46 or similar spacing element is provided between the screw 44 and the stop element 38 to allow pivoting of the stop element 38 about an axis defined by the screw 44. The location of the aperture 42, and thus the pivoting axis, is preferably chosen to be on the end of the base portion 40 opposite the rounded area 41. The stop element 38 is located on the vertical facing surface 39 of the frame 14 in a position which allows the stop element 38 to be pivoted into an "unlocked" position as seen in FIG. 2 wherein no portion of the stop element 38 extends beyond inner edge surfaces of the frame 14 of the door 10B. That is, in the "unlocked" configuration, the stop element 38 is pivoted to an inoperative position which does not admit contact between the stop element and any portion of the sliding door 10A or any portion of the stationary lock element 21.

When in the locked configuration as is shown in FIGS. 1 and 3, the stop element 38 is seen to be pivoted toward the door 10A into a position wherein the flange 48 assumes a substantially horizontal orientation and actually abuts against the horizontal leg 24 of the stationary lock element 21. When in this position, that end of the brace portion 40 having the rounded area 21 is received within the spacing 37 located between the stationary lock element 21 and the vertical peripheral edge surface 19 of the frame 14. Opposed surfaces of the base portion 40 are thus caused to abut and be contiguous to facing surfaces of the stationary lock element 21, thereby providing a detente or stop function which prevents relative movement between the doors 10A and 10B. Accordingly, it is apparent from the foregoing description that the lock mechanism 20 can be readily installed and operated to allow relative movement between doors 10A and 10B or to prevent such relative movement by pivoting of the stop element 38 into locking engagement with the stationary lock element 21. The flange 48 of the stop element 38 can further be provided with an aperture 50 which is located in the flange 48 in a position which allows mating of the aperture 50 with the aperture 26 formed in the horizontal leg 24 of the stationary lock element 21. When in the locked configuration, the apertures 26 and 50 align in order to allow receipt of a padlock 52, as seen in FIG. 1, which provides additional security to the locking system.

Figure 4:
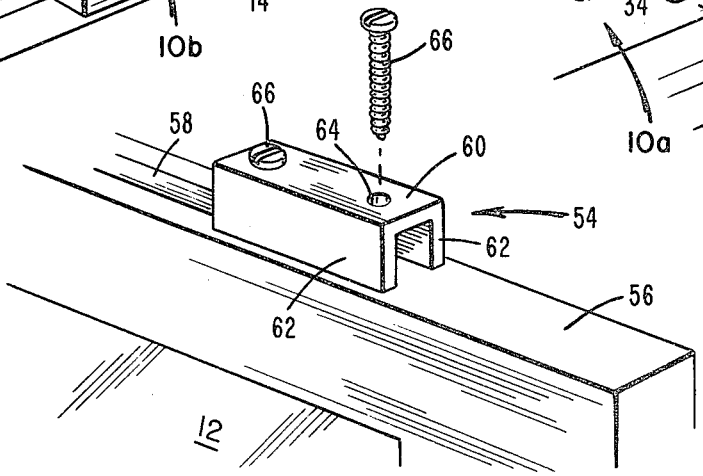
FIG. 4 is a perspective view of a blocking member which forms a portion of the present locking system, the usual upper track associated with sliding patio doors being removed in order to show the preferred location of the blocking member on the door.

As can particularly be seen in FIGS. 1 and 4, the present locking system further comprises one or more blocking bars 54 which are disposed along upper horizontal facing surfaces 56 of the doors 10A and 10B. Typically, one blocking bar 54 is provided for each door, the function of the bars 54 being to prevent lifting out of the doors 10A and 10B from tracks 58 within which the doors move. The bars 54 essentially comprise U-shaped metal bodies 60 having longitudinally extending ledge-like legs 62 which cradle the upper portion of the frame 14 and facilitate mounting of each bar 54 to the respective frame 14. Each bar 54 is provided with one or more drilled holes 64 for receiving screws 66 which mount the bars 54 in position. The bars 54 are sized to allow movement of the doors 10A and 10B within the tracks 58 but do not allow sufficient clearance to make possible the lifting out of the doors from the tracks.

Accordingly, it is seen from the foregoing that a locking system is provided for sliding closures such as the sliding patio doors 10A and 10B. While a preferred embodiment of the invention has been explicitly described, it is to be understood that the sub-systems of the present locking system can be configured other than as explicitly shown without departing from the scope of the invention as defined by the appended claims.

What is claimed is:

1. A locking system for securing sliding closures which move within tracks and wherein at least one of the sliding closures comprises a glass patio door formed of a glass pane and a frame mounting the pane to form a recess defined by the pane and peripheral edge surfaces of the frame bounding said pane, comprising:

locking means attached to the closures for preventing relative movement therebetween when in an operative configuration and for allowing relative movement between the sliding closures when in an inoperative configuration, the locking means comprising a stationary locking element mounted to a face of one of the closures and a pivotable stop element mounted to a leading edge of the other closure, the stop element being pivotable to a blocking relationship with the stationary locking element to prevent movement between the closures, the stationary locking element further comprising a U-shaped portion and a flange portion extending vertically from a first leg of the U-shaped portion when the stationary locking element is disposed with the longitudinal axis thereof in a vertical orientation, the U-shaped portion fitting into the recess contiguous to lower horizontal peripheral edge surfaces of the frame and being spaced from vertical peripheral edge surfaces of the frame, and means for mounting the stationary mounting element to the frame; and, blocking means disposed upon upper horizontal frame surfaces of the closures between said closures and the tracks for preventing the closures from being lifted out of the tracks.

2. The locking system of claim 1 wherein the mounting means comprise a screw element and wherein the flange has at least one slot therein for receiving said screw element, the screw element fastening to the frame to hold the stationary locking element to said frame.

3. The locking system of claim 1 wherein a second free leg of the U-shaped portion is disposed substantially in a horizontal orientation when mounted to the door, the free leg having an aperture formed therein, and wherein the free leg does not extend sufficiently from the recess to impede relative movement between the sliding closures.

4. The locking system of claim 1 wherein the stop element is formed of a planar base portion which is mounted contiguously and pivotally to the leading edge of the other closure, the stop element further having a planar flange which is disposed perpendicularly relative to the planar base portion and extends outwardly thereof, an inner end of the base portion fitting between the stationary locking element and the vertical peripheral edge surface of the frame from which the stationary locking element is spaced, thereby to bias against the stationary locking element and block relative movement between the closures, the planar flange of the stop element fitting over the free leg of the stationary locking element when said stop element is pivoted into a locking relationship with the stationary locking element, the planar flange having an aperture formed therein which aligns with the aperture formed in the free leg.

5. The locking system of claim 4 and further comprising a padlock attached through the aperture formed in the free leg of the stationary locking element and in the planar flange of the stop element for further securing the locking means.

6. The locking system of claim 4 wherein at least a portion of the end of the base portion which fits between the stationary locking element and the frame of the door is rounded about the free edge thereof.

7. The locking system of claim 1 wherein the blocking means comprise a locking bar which is substantially a rectangular solid in conformation and which has at least one aperture, the blocking means further comprising screw means received within the aperture for fastening the bar to the frame of the closure.

8. A locking mechanism for securing sliding closures such as patio doors which move within tracks and wherein at least one of the doors is formed of a glass pane and a frame mounting the pane to form a recess defined by the pane and peripheral edge surfaces of the frame bounding said pane, the locking mechanism comprising:

a stationary locking element mounted to a face of one of the closures; and, a pivotable stop element mounted to the leading edge of the other closure, the stop element being pivotable to a blocking relationship with the stationary element to prevent movement between the closures, the stationary locking element comprising a U-shaped portion and a flange portion extending vertically from a first leg of the U-shaped portion when the stationary locking element is disposed with the longitudinal axis thereof in a vertical orientation, the U-shaped portion fitting into the recess contiguous to the lower horizontal peripheral edge surfaces of the frame and being spaced from vertical peripheral edge surfaces of the frame, a second free leg of the U-shaped portion being disposed substantially in a horizontal orientation when mounted to the door, the free leg having an aperture formed therein, the stop element being formed of a planar base portion mounted contiguously and pivotally to the leading edge of the other closure, the stop element further having a planar flange which is disposed perpendicularly relative to the inner base portion and extending outwardly thereof, an inner end of the base portion fitting between the stationary locking element and the vertical peripheral edge surface of the frame from which the stationary locking element is spaced, thereby to bias against the stationary locking element and block relative movement between the closures, the planar flange of the stop element fitting over the free leg of the stationary locking element when said stop element is pivoted into a locking relationship with the stationary locking element, the planar flange having an aperture formed therein which aligns with the aperture formed in the free leg to allow receipt of a padlock or similar element thereinto to further lock the sliding closures.

9. A locking mechanism for securing sliding closures such as patio doors which move within tracks, the locking mechanism comprising:

a stationary locking element mounted to a face of one of the closures and comprising a U-shaped portion and a flange portion extending vertically from a first leg of the U-shaped portion when the stationary locking element is disposed with the longitudinal axis thereof in a vertical orientation; and, a pivotable stop element mounted to the leading edge of the other closure, the stop element being pivotable to a blocking relationship with the stationary locking element to prevent movement between the closures.

10. The locking mechanism of claim 9 wherein at least one of the sliding closures comprises a glass patio door formed of a glass pane and a frame mounting the pane to form a recess defined by the pane and peripheral edge surfaces of the frame bounding said pane, the U-shaped portion of the stationary locking element fitting into the recess contiguous to lower horizontal peripheral edge surfaces of the frame and being spaced from vertical peripheral edge surfaces of the frame, and means for mounting the stationary mounting element to the frame.

11. The locking mechanism of claim 10 wherein the mounting means comprise a screw element and wherein the flange has at least one slot formed therein for receiving said screw element, the screw element fastening to the frame to hold the stationary locking element to said frame.

12. The locking mechanism of claim 10 wherein a second free leg of the U-shaped portion is disposed substantially in a horizontal orientation when mounted to the door, the free leg having an aperture formed therein, and wherein the free leg does not extend sufficiently from the recess to impede relative movement between the sliding closures.

13. The locking mechanism of claim 10 wherein the stop element is formed of a planar base portion which is mounted contiguously and pivotally to the leading edge of the other closure, the stop element further having a planar flange which is disposed perpendicularly relative to the planar base portion and extends outwardly thereof, an inner end of the base portion fitting between the stationary locking element and the vertical peripheral edge of the surface of the frame from which the stationary locking element is spaced, thereby to bias against the stationary locking element and block relative movement between the closures, the planar flange of the stop element fitting over the free leg of the stationary locking element when said stop element is pivoted into a locking relationship with the stationary locking element, the planar flange having an aperture formed therein which aligns with the aperture formed in the free leg.

14. The locking mechanism of claim 13 and further comprising a padlock attached through the aperture formed in the free leg of the stationary locking element and in the planar flange of the stop element for further securing the locking means.

15. The locking mechanism of claim 13 wherein at least a portion of the end of the base portion which fits between the stationary locking element and the frame of the door is rounded about the free edge thereof.

* * * * *